US007931508B1

(12) United States Patent
Carr

(10) Patent No.: US 7,931,508 B1
(45) Date of Patent: Apr. 26, 2011

(54) MULTI-FIT TRANSFORMER STUD MOUNTING AND METHODS OF MAKING THE SAME

(76) Inventor: James E. Carr, Lebanon, MO (US)

( * ) Notice: Subject to any disclaimer, the term of this patent is extended or adjusted under 35 U.S.C. 154(b) by 0 days.

(21) Appl. No.: 12/698,075

(22) Filed: Feb. 1, 2010

Related U.S. Application Data

(60) Provisional application No. 61/153,857, filed on Feb. 19, 2009.

(51) Int. Cl.
*H01R 11/09* (2006.01)

(52) U.S. Cl. ..... 439/798

(58) Field of Classification Search ..... 439/798, 439/814, 796, 810
See application file for complete search history.

(56) References Cited

U.S. PATENT DOCUMENTS

| | | | | |
|---|---|---|---|---|
| 5,690,516 | A | 11/1997 | Fillinger | |
| 5,931,708 | A | 8/1999 | Annas et al. | |
| 6,579,131 | B1 * | 6/2003 | Ashcraft et al. | 439/798 |
| 6,939,183 | B2 | 9/2005 | Ferrettin et al. | |
| 7,014,514 | B2 | 3/2006 | Zahnen | |
| 7,320,626 | B2 | 1/2008 | Drane et al. | |
| 7,338,333 | B2 * | 3/2008 | Norden | 439/814 |
| 2008/0188140 | A1 | 8/2008 | Hill et al. | |
| 2009/0163087 | A1 * | 6/2009 | Sweeney et al. | 439/798 |

* cited by examiner

*Primary Examiner* — Phuong K Dinh
(74) *Attorney, Agent, or Firm* — Richard L. Marsh

(57) ABSTRACT

An electrical connector is provided with a stud connector hole disposed into one end thereof which has a shallow V-groove therein, the flanks of the V-groove provided with threads for both sizes of studs commonly disposed therein wherein the threads of the smaller diameter stud are disposed into the flanks of the V-groove spaced from the threads of the larger diameter stud. The shallow V-groove provides at least two areas of contact on either size stud inserted therein, the areas of contact maintained along the length of the stud.

9 Claims, 3 Drawing Sheets

MULTI-FIT TRANSFORMER STUD MOUNTING AND METHODS OF MAKING THE SAME

RELATED APPLICATION DATA

This application is a non-provisional application claiming the priority date of provisional application Ser. No. 61/153,857 filed on 19 Feb. 2009, the specification contained therein incorporated into this application by this reference thereto.

BACKGROUND OF THE INVENTION

1. Field of the Invention

This invention relates to an electrical terminal connector for a receiving the threaded shaft of a slip fit stud connector of a transformer thereonto, the electrical terminal connector having at least two bearing surfaces for each size stud connector.

2. Prior Art Statement

It is known to provide only one thread in a substantially larger bore so different connectors are required for different studs. For instance, see U.S. Pat. No. 5,690,516 issued on 25 Nov. 1997 to David R. Fillinger. The simplicity leads to the primary drawback, different connectors for different stud diameters. A need exists for a multiple size slip fit connector to accommodate different size studs.

It is further known to provide threads on the same surface which provides only a line contact with either thread since the larger thread diameter is greater than a standard one inch stud. For instance, see the U.S. Pat. No. 7,320,626 B2 issued on 22 Jan. 2008, to Drane, et al., or the U.S. Pat. No. 6,939,183 B2 issued on 6 Sep. 2005, to Ferretti, et al. Drane, et al., and Ferretti, et al., only differ in the diameter of the stud hole in the connector. Since only line contact is established with any stud inserted into the stud hole, clamping by the set screws to hold the connector onto the stud would not provide sufficient holding force, especially for the smaller stud. Therefore, there is a need to establish multiple points of contact with the stud thread opposite the set screws to ensure proper holding force.

It is also known to provide a multiple sized transformer stud that has at least four threaded surfaces on at least two different thread diameters. Every thread is "bifurcated," and therefore the stud touches the threads in two places opposite the set screws. For instance, see the U.S. Pat. No. 7,014,514 B2 issued on 21 Mar. 2006 to James L. Zahnen. The thread diameters do not exactly match the stud diameters so again there is only line contact with the stud even though the stud touches the threaded hole in two places. Since the threads do not match the stud threads, over tightening of the set screws is commonplace to ensure that full electrical contact is made between the stud and the connector threads. Often, this results in destruction of the stud connector through the sidewalls and the technician must replace the broken connector before finishing connections. Therefore, there is a need to exactly match thread contact with the stud threads opposite the set screws to ensure proper holding force without over tightening.

Additionally, it is known to provide three offset bores for a slip fit connector stud, one for the small stud thread, one for the large stud thread and a larger bore to provide for slip fitting the connector onto either stud. Full thread contact is provided on both studs at least for a portion of the periphery of the stud. For instance, see U.S. Pat. No. 6,579,131 B1 issued on 17 Jun. 2003 to Ashcraft, et al. Though significant contact is provided for both the large stud and the small stud commonly used for an electrical connector, manufacture of the stud connector is difficult and costly as five machining operations, three drilling operations on three different centers and two threading operations, are required to produce the slip fit connector. Accordingly, there is a great need for a slip fit connector that has fewer machining operations at greatly reduced cost.

Another known stud connector is provided with multiple bores, each having an exact thread which produce line contact on the larger thread at two points, ie where the smaller thread is provided into the larger bore. There remains full thread contact with the smaller stud in the smaller threaded hole. For instance, see the U.S. Patent Publication 2008/0188140A1 published on 7 Aug. 2008 by Hill, et al. As with Ashcraft, et al., considerable machining time is required to provide for the multiple bores and to define an exact thread in each bore. It is readily apparent, then, that a need still exists for a slip fit connector having multiple points of contact with any thread disposed therein.

Still further known is a stud connector that consists of a plurality of transverse ribs each with a centrally located semicircular notch. For instance, see the U.S. Pat. No. 5,931,708 issued on 3 Aug. 1999 to Annas, et al. The transverse ribs are formed when the electrical connector is extruded and thus requires a separate collar to connect the stud to the electrical connector. The collar is slipped over the stud and then the stud connector assembled to the collar prior to tightening the screws. The separate parts are subject to loss as they are difficult to handle by a linesman on a pole wearing gloves. Thus, a need still exists for a slip fit stud connector that has multiple contacts with either size stud inserted therein.

Finally, it is also known to provide a stud connector that consists of a plurality of longitudinal ribs having apices at different locations from a center thereof. For instance, see the U.S. Pat. No. 7,338,333 B2 issued on 4 Mar. 2008 to Alexander Roy Norden. The longitudinal ribs are formed when the electrical connector is extruded and thus requires a separate cap nut to connect the stud to the electrical connector. The cap nut must held in place over the stud while slipping the stud into the hole between the cap nut and the longitudinal ribs prior to tightening the screws. As with Annas, et al., the separate parts are subject to loss as they are difficult to handle by a linesman on a pole wearing gloves. Thus, a need still exists for a slip fit stud connector that has multiple contacts with either size stud inserted therein.

SUMMARY OF THE INVENTION

A primary object of this invention is to provide an electrical connector having a stud connector hole therein that provides at least two areas of contact on one side of either size stud inserted therein, the areas of contact maintained along a length of a stud.

Another object of this invention is to provide an electrical connector having a stud connector hole that has a shallow V-groove therein, the V-groove disposed opposite the set screws which hold the electrical connector onto a stud.

A primary goal of this invention is to provide an electrical connector having a stud connector hole that has a shallow V-groove therein, the flanks of the V-groove provided with threads for both sizes of studs commonly disposed therein wherein the threads of the smaller diameter stud are disposed into the flanks of the V-groove spaced from the threads of the larger diameter stud.

A main purpose of this invention is to provide a stud connector hole having a straight wall intersecting a shallow V-groove, the flanks of the V-groove provided with threads for both size studs for receiving a stud therein.

A significant feature of this invention is to provide a stud connector hole having a circular upper portion, a straight wall portion and a shallow V-groove portion.

A primary principle of this invention is to provide a stud connector hole having a straight wall intersecting a shallow V-groove wherein the straight walls and the shallow V-groove are formed by punch broaching the primary hole.

A principal aim of this invention is to provide a stud connector hole having an angle between the flanks of a V-groove of between 45 and 170 degrees and more specifically between 110 and 135 degrees.

A primary aspect of this invention is to provide a stud connector that is economically produced.

DESCRIPTION OF THE PREFERRED EMBODIMENTS

While the various features of this invention are hereinafter described and illustrated as an electrical connector having a stud connector hole that has a shallow V-groove wherein at least two points of contact are established for each size stud to be inserted therein, it is to be understood that the various features of this invention can be used singly or in various combinations thereof an electrical connector stud connector hole as can hereinafter be appreciated from a reading of the following description.

Figure 1:
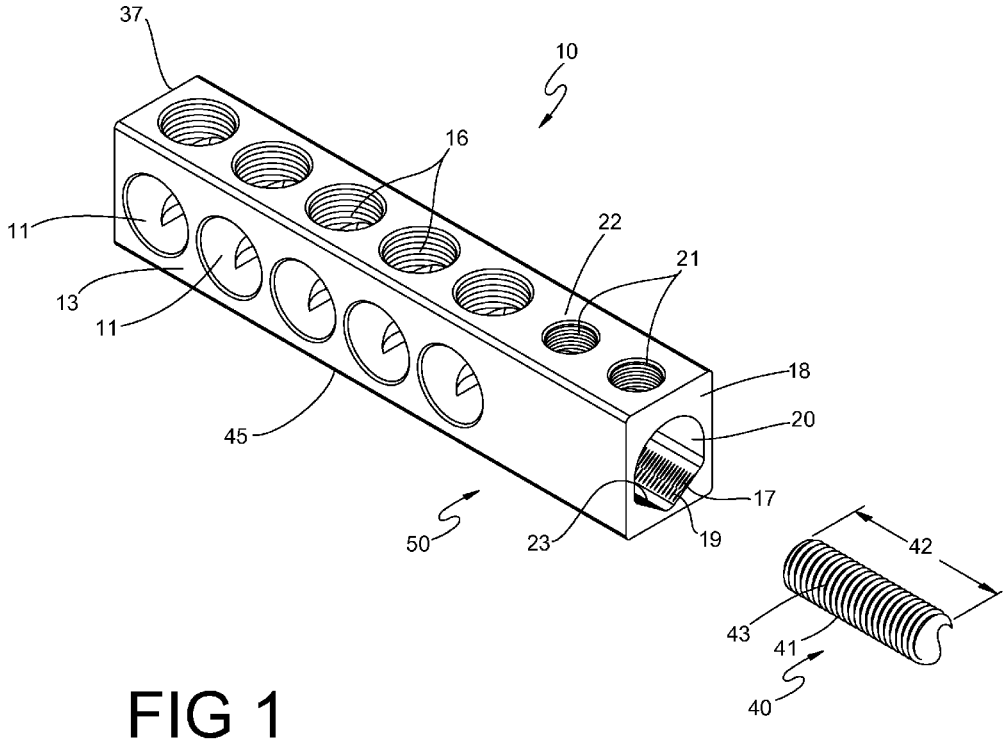
FIG. 1 is a perspective view of an electrical connector having a preferred stud connector hole disposed in one end thereof.

Referring now to FIG. 1, an electrical connector primarily intended for installation on a transformer stud 40 is generally shown by the numeral 10. Electrical connector 10 has a plurality of conductor holes 11 disposed therein, conductor holes 11 also having set screw holes 16 associated therewith, set screw holes 16 provided with set screws, not shown, to firmly attach conductors to electrical connector 10. Electrical connector 10 has a stud connection hole 20 disposed in an end 18 thereof, stud connection hole 20 provided for attachment of electrical connector 10 to stud 40 protruding from a transformer or bus bar as is well known in the art. Stud connection hole 20 of this invention has a shallow V-groove 23 disposed into angled surfaces 47 thereof, angled surfaces 47 of shallow V-groove 23 provided with at least two threads 17, 19, best shown in FIG. 3, for cooperating with the threaded stud of the transformer or bus bar to fix electrical connector 10 thereto. Stud connection hole 20 also has at least one, and preferably two, set screw holes 21 provided in a surface 22 of electrical connector 10, set screw holes 21 preferably disposed opposite to threads 17, 19. Set screw holes 21 are threaded for receiving set screws, not shown, therein.

Figure 2:
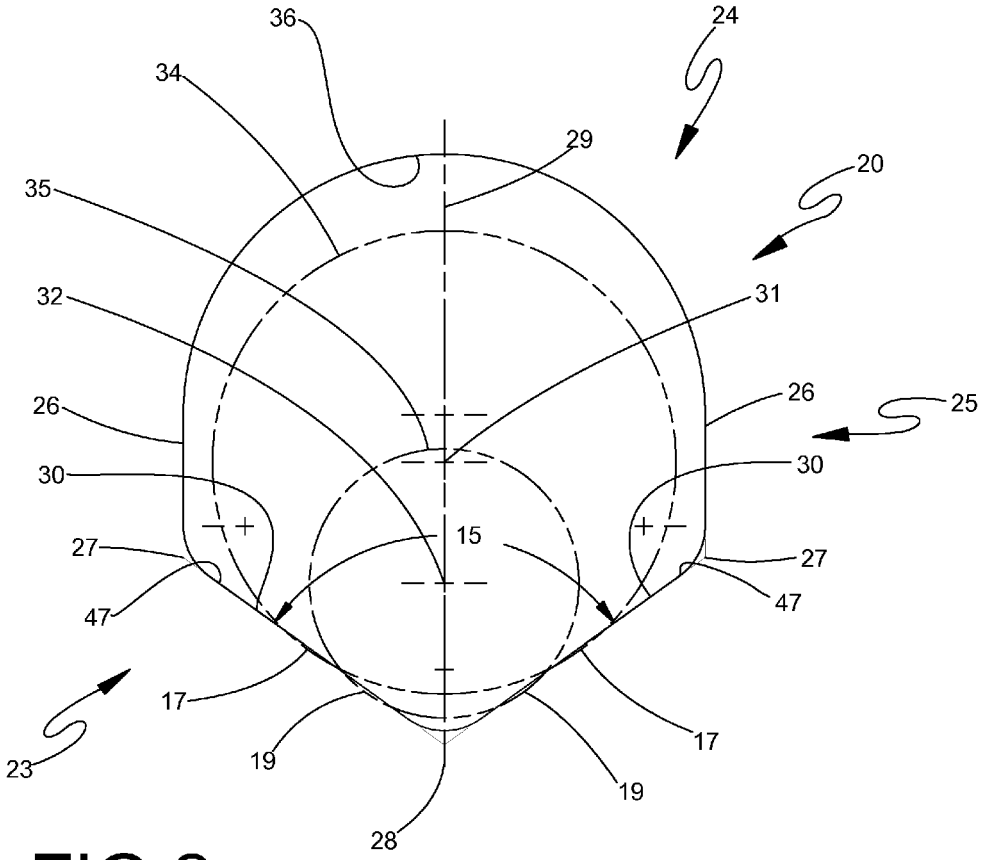
FIG. 2 is a frontal plan view of the preferred embodiment showing the straight wall sides intersecting the shallow V-groove.
Figure 3:
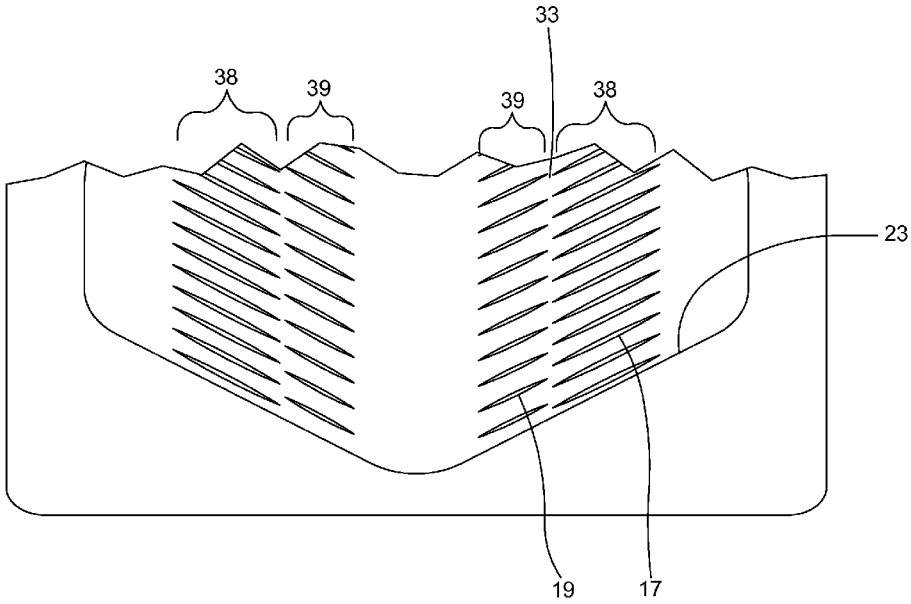
FIG. 3 is a fragmentary view into the stud connector hole of FIG. 1 showing an enlarged view of the threads disposed on the flanks of the V-groove.

More specifically and referring to FIGS. 1 through 3, stud mount electrical connector 10 comprises an elongated cubic body member 50 of highly conductive material with stud connector hole 20 disposed into one end 18 thereof, at least one set screw hole 21 provided in one longitudinal external surface 22 extending into stud connector hole 20, stud connector hole 20 adapted to receive one of at least two different size studs therein. Stud connector hole 20 comprising a semi-circular surface 36 having a diameter greater than a diameter of a largest of different sizes of studs 40, parallel sides 25 tangent to semi-circular surface 36, angled surfaces 30 intersecting parallel sides 25, angled surfaces 30 terminating in an apex 28 on a centerline 29 of semi-circular surface 36. Angled surfaces 30 are provided with threaded areas of contact 17, 19 thereupon, areas of contact 17, 19 corresponding to thread helices of different sizes of studs 40, areas of contact 17, 19 providing at least two areas of contact on an external periphery 43 of connector stud 40 inserted in stud connector hole 20. At least one conductor hole 11 is provided through an external longitudinal surface 13 perpendicular to longitudinal external surface 22, conductor hole 11 extending through body 50 from external longitudinal surface 13 to a parallel external longitudinal surface 14. A setting screw hole 16 is disposed through body member 50 from longitudinal external surface 22 into conductor hole 11, setting screw hole 16 intersecting conductor hole 11 and extending into a base 45 of body member 50. Stud set screw holes 21 disposed into external surface 22 extend through semi-circular surface 36 wherein set screws inserted therein are adapted to hold stud 40 against threaded areas of contact 17, 19 of V-groove 23.

Referring now to FIG. 2, the exemplary portions of this invention will be described in detail. Stud connection hole 20 comprises a semi-circular upper half 24, a straight wall portion 25 and a shallow V-groove 23. Semi-circular upper half 24 is larger in cross sectional diameter than the largest stud to be inserted therein and preferably is from about 2 percent to about 20 percent larger than the largest stud diameter of one inch. Most preferably, semi-circular upper half has a diameter of 1.050 to 1.060 inches to allow for easy installation of electrical connector 10 upon a protruding stud 40. Straight wall portions 25 extend downwardly from points of tangency 26 with semi-circular upper half 24 approximately one-quarter inch to provide clearance for the larger stud. Straight wall portions 25 intersect shallow V-groove 23 at intersection points 27 wherein shallow V-groove 23 extends downwardly at an angle with respect to straight wall section 25. Apex 28 of shallow V-groove 23 is disposed on a center line 29 of stud connector hole 20, shallow V-groove 23 thus comprised of two sloping flanks 30 for receiving threads 17, 19 thereupon. Flanks 30 are preferably disposed at an angle 15 of between 45 and 170 degrees and more specifically between 110 and 135 degrees. Radii may be provided at intersection points 27 and apex 28, however, it is fully within the scope of the invention to provide for sharp angle intersections 27, 28 as shown.

Still referring to FIG. 2, but also with reference to FIG. 3, thread 17 is a 1-14 UNF-2B and is disposed onto flanks 30 closer to intersection point 27 than thread 19 as is clearly evident in FIG. 3. Thread 19 is a ⅝-11 UNF-2B and is disposed onto flanks 30 closer to apex 28 than thread 17. Thread 17 corresponds to the thread provided on the larger stud used on transformers and bus bars while thread 19 corresponds to the smaller stud. Threads 17 and 19 are produced by threading tools disposed at center points 31, 32 respectively and preferably, center points 31, 32 of threads 17, 19 are spaced apart to ensure that threads 19 of the smaller stud do not interfere with the threads 17 of the larger stud. Thread circles 34, 35 show the clearance of the larger stud from the inside surface 36 of semi-circular upper half 24 and the placement of the studs upon angled flanks 30. Since threads 17, 19 touch flanks 30 in different areas and as thread 17 is larger in diameter, thread 17 is thus disposed onto flanks 30 closer to intersection point 27 than thread 19 as is clearly evident in FIG. 3. Likewise, thread 19 thus disposed onto flanks 30 closer to apex 28 than thread 17 and a clearance 33 exists between threads 17 and 19 at preferred angle 15. Threads 17, 19 disposed onto flanks 30 provide at least two areas 38, 39 of contact for either size stud inserted therein, these areas 38, 39 of contact maintained along the length of the threads 17 or 19 and hence along the length 41 of threads 42 of stud 40 within stud connector hole 20. Since threads 17, 19 fully engage threads 41 of stud 40 along the length within stud connector hole 20, electrical connector 10 is firmly held to stud 40 upon tightening set screws against stud 40 opposite threads 17, 19. It should be readily apparent that as angle 15 is increased, thread 17 will move toward thread 19 and will become largely superimposed upon thread 19 at the largest angle of 170 degrees. Of course, if angle 15 is increased, the length of sidewalls 25 are increased accordingly to allow for slip fitting of stud 40 into connector hole 20. Likewise, as angle 15 is decreased, threads 17 and 19 will move apart thus increasing clearance 33 therebetween and sidewalls 25 are shortened. With the preferred angle of 126 degrees, the best balance between slip fit allowance and engagement of threads 17, 19 with the threads of the different studs is provided. Proximate preferred angle of 126 degrees, threaded areas of contact 17, 19 of V-groove are disposed upon flanks 30 of V-groove 23 wherein threads of a smaller diameter stud of different size studs 40 are disposed into flanks 30 of V-groove 23 substantially contiguous with threads of a larger diameter stud of different size studs 40.

Electrical connector 10 may be economically produced by machining holes 11, 16, 20 and 21 into an elongated portion of bar stock, punch broaching straight portions 25 and angled surface 23, threading holes 16 and 21, producing thread 17 onto flanks 30 by rotating a 1-14 UNF-2B threading tool about a center point 31 disposed on centerline 29 and finally producing thread 19 onto flanks 30 by similarly rotating a ⅝-11 UNF-2B threading tool about a center point 32 disposed on centerline 29. Electrical connector 10 may also be economically produced by extruding a bar in a width from end 18 to end 37 while producing holes 11 therethrough. The bar may then be cut to a width equal to the width between sides 13 and 14 and thereafter machining holes 16, 20 and 21 thereinto, punch broaching straight portions 25 and angled surface 23, threading holes 16 and 21 and producing threads 17 and 18 onto flanks 30. In yet another economical method of manufacture, electrical connector 10 may be die cast wherein holes 11, 16, 20 and 21 are formed simultaneously into electrical connector 10 and thereafter punch broaching straight portions 25 and angled surface 23, threading holes 16 and 21, and producing threads 17 and 18 onto flanks 30.

While the present invention has been described with reference to the above described preferred embodiments and alternate embodiments, it should be noted that various other embodiments and modifications may be made without departing from the spirit of the invention. Therefore, the embodiments described herein and the drawings appended hereto are merely illustrative of the features of the invention and should not be construed to be the only variants thereof nor limited thereto.

I claim:

1. A stud mount electrical connector comprises a cubic body member of highly conductive material provided with a stud connector hole disposed into at least one external surface thereof, a plurality of conductor holes provided in at least one other external surface thereof, a plurality of set screw holes provided in an external surface perpendicular to said conductor holes and set screw holes provided in an external surface perpendicular to said stud connector hole, said stud connector hole adapted to receive one of at least two different size studs therein, said stud connector hole comprising a semi-circular surface having a diameter greater than a diameter of a largest of said different size studs, parallel sides tangent to said semi-circular surface, angled surfaces intersecting said parallel sides, said angled surfaces terminating in an apex on a centerline of said semi-circular surface, said angled surfaces provided with threaded areas of contact thereupon, said areas of contact corresponding to thread helices of said different size studs, said areas of contact providing at least two areas of contact on an external periphery of a connector stud inserted in said stud connector hole, said areas of contact maintained along a length of a portion of threads of said stud inserted into said stud connector hole.

2. A stud connector as in claim 1 wherein said angled surfaces of said stud connector hole comprise a shallow V-groove, said V-groove disposed opposite said semicircular surface.

3. A stud connector as in claim 2 wherein said stud set screw holes disposed into said external surface extend through said semi-circular surface wherein set screws inserted therein are adapted to hold said stud against said threaded areas of contact of said V-groove.

4. A stud connector as in claim 3 wherein said threaded areas of contact of said V-groove are disposed upon flanks of said V-groove wherein threads of a smaller diameter stud of said different size studs are disposed into said flanks of said V-groove contiguous with threads of a larger diameter stud of said different size studs.

5. A stud connector as in claim 4 wherein said flanks of said V-groove are disposed at an angle between 45 and 170 degrees.

6. A stud connector as in claim 5 wherein said flanks of said V-groove are disposed at an angle between 110 and 135 degrees.

7. A stud connector as in claim 3 wherein said threaded areas of contact of said V-groove are disposed upon flanks of said V-groove wherein threads of a smaller diameter stud of said different size studs are disposed into said flanks of said V-groove spaced from threads of a larger diameter stud of said different size studs.

8. A stud connector as in claim 4 wherein said flanks of said V-groove are disposed at an angle between 45 and 170 degrees.

9. A stud connector as in claim 5 wherein said flanks of said V-groove are disposed at an angle between 110 and 135 degrees.

* * * * *